United States Patent [19]

Townsend et al.

[11] Patent Number: 4,608,963

[45] Date of Patent: Sep. 2, 1986

[54] THERMALLY BALANCED AIR FLOW CHIMNEY

[75] Inventors: Donald M. Townsend, Mill Valley; John R. Jacklich, Palo Alto, both of Calif.

[73] Assignee: Simpson Dura Vent Company, Inc., Vacaville, Calif.

[21] Appl. No.: 688,714

[22] Filed: Jan. 4, 1985

[51] Int. Cl.[4] ..... F23L 17/02

[52] U.S. Cl. ..... 126/307 R; 98/60

[58] Field of Search ..... 98/60; 110/184; 126/307 R, 312, 316

[56] References Cited

U.S. PATENT DOCUMENTS

| | | | |
|---|---|---|---|
| 784,963 | 3/1905 | Reynolds | 126/312 X |
| 1,966,620 | 7/1934 | Fluor, Jr. | 126/307 R |
| 1,988,642 | 1/1935 | Wolbers | 126/307 R X |
| 2,116,118 | 5/1938 | Leash | 126/307 R |
| 2,634,720 | 4/1953 | Thulman | 126/307 R |
| 2,687,127 | 8/1954 | Leffler | 126/307 |
| 2,718,841 | 9/1955 | Kinkead | 126/307 R X |
| 2,818,060 | 12/1957 | Field | 126/307 |
| 2,898,839 | 8/1959 | McKann | 126/307 R X |
| 3,522,767 | 8/1970 | Derringer | 126/307 R |
| 3,842,721 | 10/1974 | Cardiff | 98/60 |
| 4,502,370 | 3/1985 | Baileys et al. | 126/307 R X |

*Primary Examiner*—Harold Joyce

*Attorney, Agent, or Firm*—James R. Cypher

[57] ABSTRACT

A triple wall factory built thermally balanced on demand air flow metal chimney system in which the chimney sections are formed with an insulation chamber filled with insulation material which surrounds the chimney flue and an air passage chamber surrounding the insulation chamber. A negligible amount of cooling air flows upwardly through the air passage chamber during normal operation of the chimney. The air flow is separated from the inner flue by the insulating blanket. This allows the flue to maintain the proper elevated temperatures to resist creosote deposits. During periods of sustained high temperature operation or creosote fire episodes, substantial on demand cooling air flows upwardly through the air passage chamber drawing off heat from the inner flue and the outer wall.

9 Claims, 10 Drawing Figures

70
68
70
27
26
25
13
15
12
16
17
14
19
18
28
28
27
26
32
70
71
69
68
9
35
9
71
70
51
36
50
34
70
7
7
49
37
17'
49
18'
72
33
15'
20
14'
69
70
29
2
17'
72
13'
2
33
30
16'
19'
70
20
6
6
20
70
68
13'
67
23
21
22
46
47
35
24
48
11
68

10

THERMALLY BALANCED AIR FLOW CHIMNEY

BACKGROUND

The chimney is a comparatively recent invention. Prior to the 14th century, man was content to let the smoke from his fire escape into the air through a simple hole in the roof. Chimneys did appear in Europe after the 14th century and in England, they were made of brick. The masonry chimney was the standard for nearly 7 centuries and is still widely used.

As central heating, using gas or oil furnaces became popular and masonry chimneys became more expensive, metal chimneys appeared about 30 years ago. Later, double wall metal chimneys were introduced and they were quite adequate for the generally lower temperature of oil or gas furnaces and open fireplaces burning solid fuels.

During the mid-seventies, however, there was a resurgence in the use of fireplaces, and metal stoves which burned wood and/or coal. Since solid fuels can create higher temperatures, and there is less regulation of the amount of fuel packed into a fireplace or stove, the need for chimneys, both masonry and metal, to withstand higher sustained temperatures was required. Further, "airtight" stoves, that is, those that will suffocate a fire by closing the air intakes, exacerbated the problem of creosote accumulation in the inner wall of the chimney and hence very high temperature creosote fires.

To meet the problem of higher temperatures, the makers of metal chimneys developed the reverse syphon chimney. This chimney had a triple wall with cold outside atmospheric air being introduced from the top of the chimney into the outer chamber which then was drawn down to the base of the chimney and rose up the inner chamber next to the inner flue. While this system keeps the outer wall of the chimney cool so that it does keep combustible material next to the chimney below 200° F. most of the time, it has been found that it keeps the inner flue too cool, thus condensing creosote on the inner flue. If the creosote is permitted to build-up and an overly hot fire ignites the creosote, an extremely hot fire results inside the chimney which can cause damage to the metal chimney by buckling due to the thermal expansion of the metal. Further, the intense heat can cause breaking of welds, and expansion of seams. This structural failure of the inner flue can permit heat to escape to the outer chamber where the increase in temperature can cause ignition of the combustible material surrounding the chimney resulting in a house fire.

Other metal chimney manufacturers have provided a double walled chimney and filled the chamber with a fine powdered insulation. While this keeps the inner flue temperature relatively high and minimizes the creosote build-up problem, extremely hot fires for extended periods of time cause excessively hot flue temperatures, thermal expansion of the metal, buckling of the inner flue and flow of the insulation into buckled areas or out through buckled seams. If air voids form in the insulated chimney wall as the result of very hot fires, "hot spots" occur in the chimney which can ignite combustibles next to the chimney.

It was observed that simply adding additional insulation around the flue liner to keep the outer wall cool even with triple wall chimneys had the adverse effect of permitting the inner flue liner to get too hot resulting in excessive thermal elongation and diameter expansion resulting in seam failure and buckling.

Finally, the tensile strength of steel decreases rapidly above 800° F. Since the thermal expansion of steel increases with increase in temperatures, extremely hot fires can stress the metal chimney beyond the yield point so that it does not return to its original shape. This can open up spaces in the chimney possibly resulting in a fire in the structure at a later time.

In 1954, Leffler, U.S. Pat. No. 2,687,127 was granted a patent on a triple wall metal chimney. No insulation material was used. An unrestricted amount of air was withdrawn from inside the building for cooling the chimney. The inner flue would be excessively chilled, creating a build-up of creosote in the inner chimney flue.

In 1957, Field, U.S. Pat. No. 2,818,060 was granted a patent on a chimney and stove system which included a triple wall uninsulated chimney in which air was drawn from outside the building and down an outer annular passage of the chimney to the fire box of the stove where it served as combustion air. The system, like the thermal syphon chimney, would cool the inner flue and result in the build-up of creosote.

SUMMARY OF THE INVENTION

The thermally balanced chimmey system of the present invention utilizes a triple wall sheet metal chimney construction with a blanket insulation in the chamber adjacent the inner flue. The insulation keeps the inner flue temperature elevated to minimize the deposition of creosote on the inner flue wall. The insulation is limited, however, so that the flue liner does not get too hot. Openings are formed in the outer wall of the chimney at the chimney base to permit the introduction of air to the outer chamber in the chimney to carry off the heat which passes through the insulation. The outer air chamber is continuous from the base to the top of the chimney where the warmed air is vented to atmosphere. The initial air for the flow through the outer chamber is supplied on demand from the enclosure surrounding the chimney between floors in the building or between the ceiling and the roof of the building. Since no attempt is made to make this chamber air tight, in the event of a fire within the chimney as upon the ignition of creosote, additional air is drawn into the chimney from the inner space of the building itself or from the atmosphere of the structure surrounding the chimney if the chimney is constructed on the outside of the building. The flow of air from the base of the chimney to the top of the chimney and to the atmosphere draws off heat from the inner flue and maintains the outer wall of the chimney below the temperature at which it will ignite the combustible materials adjacent a properly maintained chimney in a properly constructed building structure.

In an alternate form, the air for passage through the outer chamber in the chimney may be supplied from the attic area where there is no enclosure around the chimney. If there is no attic area, the air for passage through the outer chamber in the chimney may be supplied from the heated room air or from outside ambient air.

The main objects of the invention are to provide a safe chimney which will minimize the build-up of creosote, provide a good draft and can be installed quickly and easily in standard frame structures.

The design of the chimney allows for radial as well as longitudinal expansion of the inner flue.

DESCRIPTION OF THE PREFERRED EMBODIMENTS OF THE INVENTION

Figure 1:
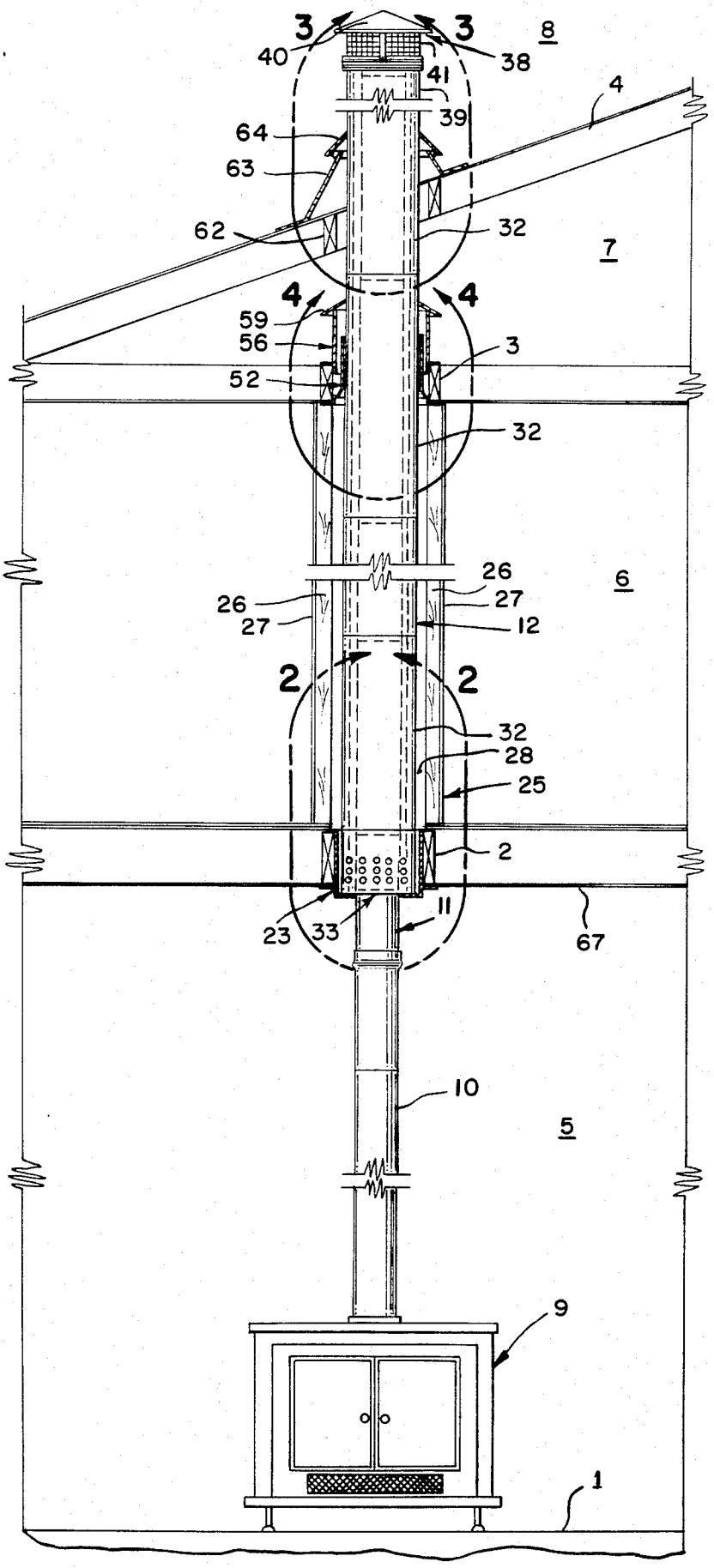
FIG. 1 is an elevation view of the chimney constructed in accordance with the present invention. A wood stove with connecting stove pipe is also illustrated. Portions of a two story house, attic and sloping roof are illustrated showing an example installation of the chimney. Portions of the system for installing the chimney are in cross section.

Referring to FIG. 1, a portion of a building is illustrated showing a floor 1, floor joist members 2, ceiling joist members 3 and roof rafters 4 which divide the building into a first floor space 5, a second floor space 6, an attic space 7 and the atmosphere outside the building which is represented by the number 8. A stove 9 rests on floor 1. An air tight stove is illustrated but is shown as an example only of a heating source. The heating source could be any appliance such as a solid-fuel burning stove, fireplace, furnace, boiler, water heater or cook stove. The appliance could burn wood, coal, gas or any combustible material. The stove is connected to a stovepipe 10 which is any standard generally air impervious single-walled light gauge metal pipe. Preferably for purposes of easy installation, the stovepipe is connected to a chimney snap lock adapter 11 which in turn is connected to the chimney 12.

The on demand air cooled chimney 12 is installed through the interior spaces of the structure, but may also be installed on the outside of the building structure as discussed more fully below.

The chimney system consists briefly of a chimney member 12 having an inner metal wall 13 forming an imperforate elongated open ended flue chamber 14 for the passage of flue gases from the fire source 9 to the atmosphere 8 outside the building. The chimney member 12 also is formed with an intermediate sheet metal wall 15 surround and generally evenly spaced from the inner wall forming therewith an insulation chamber 16. Finally, the chimney member is formed with an outer sheet metal wall 17 surrounding the intermediate wall and forming an open ended air passage chamber 18.

Insulation material 19 substantially fills the insulation chamber 16 in the chimney member. This may be any highly non-combustible material, but preferably is a blanket type material that when compressed will return to its original shape. The insulation material preferably is free standing in that it will not flow to the bottom of the chimney member and leave air voids. The insulation is a ceramic refractory blanket which meets the UL 103 H.T. test for chimneys.

An example of an insulation which may be used is KAOWOOL® ceramic fiber product manufactured by Babcock & Wilcox. This ceramic fiber is either made from kaolin, a naturally occurring, alumina-silica fireclay or a blend of high purity alumina and silica. KAOWOOL has a melting point of 3200° F., with a normal use limit of 2300° F. Fiber lengths range from 2 to 10 inches. These long fibers, thoroughly interlaced in the production process do not require a binder system. The insulation has an average fiber diameter in microns of 2.6 to 2.8; a specific gravity (ASTM C 135) of 2.56 and a specific heat in Btu-lb of 1800° F. of 0.26. The KAOWOOL insulation blankets are self-supporting and will not separate, sag or settle. The long fibers give the blanket high tensile strength and resiliency to withstand vibration and physical abuse. The blanket has low thermal conductivity, low heat storage and is extremely resistent to thermal shock.

Air passage means such as openings 20 are formed in the chimney member 12 permitting the passage of air to the air passage chamber 18 adjacent the lower end 21 of the chimney member. The required air passage means may also be obtained by simply raising the open ended chimney member above the base 22 of the chimney support member 23 thereby permitting air to enter the bottom end 24 of air passage chamber 18. Where holes are placed in the side of the starter section, their combined area should generally be about equal to the cross sectional area of air passage chamber 18.

Figure 2:
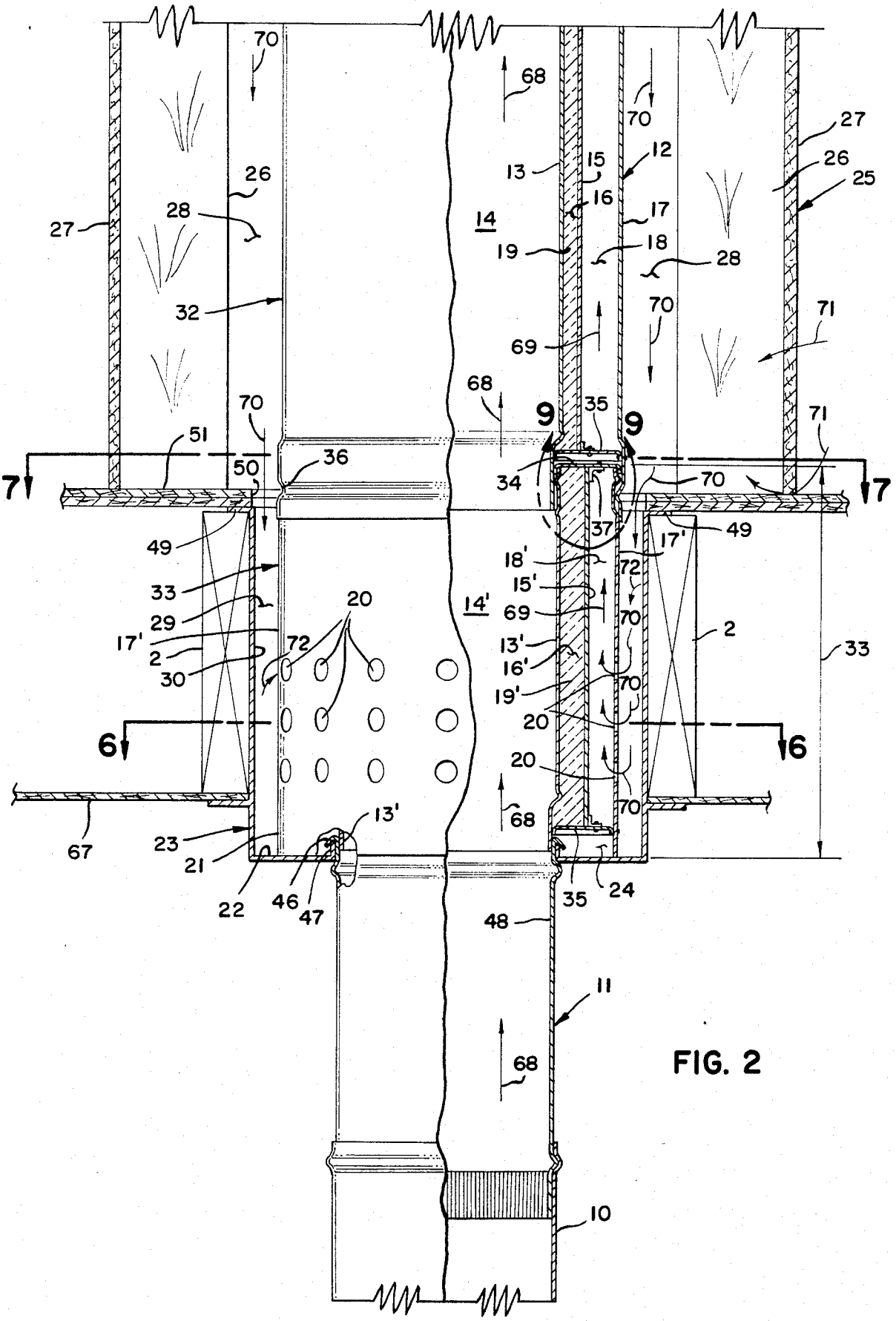
FIG. 2 is an enlarged view of the chimney shown in FIG. 1 taken along line 2—2. Portions of the chimney and installation system are shown in cross section.

As shown in FIGS. 1 and 2, an air permeable structure means 25 encloses a portion of the chimney adjacent the air passage means thereby providing a selected volume of air for immediate supply through the air passage means. There is no specific shape to the air permeable structure means and an example is shown in FIGS. 1 and 2. It is preferred that the air passage means not have direct or unrestricted access to the ambient air within the major spaces of the structure. Such a structure withdraws some of the warmed air from the inside of the building and may reduce the effectiveness of the stove or fireplace. Instead, the air permeable structure means may consist of an enclosure built around the chimney such as by using wood 2×4's 26 and cover the 2×4 studs with sheet rock panels 27. Such structures are normally required for safety reasons in second story living spaces to prevent accidental burns from the chimney and to prevent storage of flamable articles against the chimney. The air permeable structure forms an air supply chamber 28 in which all combustible materials including the wood studs and the sheet rock are spaced at least 2 inches from the outer wall of the chimney. Air supply chamber 28 is in communication with the chamber 29 formed by outer wall 17′ of the chimney starter section and the inner walls 30 of the chimney support and the inside faces of floor joist members 2 and blocking members 31.

It is to be understood that air supply chamber 28 is not air tight and that air will enter any of numerous cracks and spaces so as to withdraw ambient air from the spaces in the rooms 5 and 6 and even the attic space 7. It is preferred, however, that the flow of ambient air from inside the building be restricted so that it slowly replaces the air withdrawn through chimney air passage 18. It is expected that during normal operation of the chimney, the withdrawal of ambient air from the inside of the building will be such a slow rate as to have a negligible effect on the ambient temperature within the building. In a typically ventilated attic, the withdrawal of unheated air from the attic has no adverse effect on the efficiency of the heating system. The flow rate, however is expected to be greater during extremely hot fires or even in the event of a chimney fire due to the burning of any creosote which may have accumulated. During such times, the loss of heat within the building may be disregarded so as to carry out the more important function of cooling the chimney so that the outer wall and inner flue of the chimney may be maintained at safe operating temperatures. This change in flow of cooling air from a negligible amount during normal operation to substantial flow during cresote fires is referred to as "on demand" air flow.

The intermediate and outer chimney walls may be constructed from galvanized steel, aluminized steel or stainless steel. The inside wall may be constructed from Type 430 stainless steel. Type 430 stainless steel has acceptable levels of corrosion resistance, is a ferritic low cost alloy, offers good oxidation resistance to 1600° F., has a thermal expansion coefficient substantially lower than 300 series stainless steel, and a thermal conductivity that is substantially greater. Type 430 stainless steel at 1000° expands 0.216 inches for every 3 foot of chimney length and ⅛" in diameter. It is important that the inner wall remain relatively air tight and not buckle. Buckling or cracking due to exceeding the yield strength could result in opening up cracks which could permit the passage of flue gases to the outer air passage chamber 18.

The stainless steel used in the inner flue forms a protective oxide. If the thermal expansion is excessive, however, this protective oxide flakes off.

While it is considerably more expensive, the inside flue wall may be made as an option from high nickel content stainless steel austenitic alloys such as types 330 and 333. These alloys are best suited for furnace conditions and temperatures to 2100° F. Because of the expense, the types 330 and 333 stainless steel may be used only in the chimney starter section where the temperatures are the highest. The type 330 and 333 high nickel content austenitic alloy stainless steel has higher strength at higher temperatures, less thermal expansion and less buckling.

As previously described, the entire chimney may be a single member. This may occur if the stovepipe member reaches to the ceiling in a building without any second floor or attic such as in the popular "A" frame cabins. In such structures, the chimney is supported at the roof structure and extends the proper distance above the roof. In this installation, the openings 20 could be in the single chimney section or the chimney section might not have any holes but simply be lifted up by a foot member as previously described to permit air to circulate up the chimney air passage chamber 18.

Preferably, however, the chimney is formed in chimney sections 32 with convenient lengths of 12", 18", 2' and 3'. The section lengths may be combined to reach any height desired up to a maximum of 50' per chimney support. When such sections are used, it is desirable to provide a separate chimney starter member 33 releasably connected to the chimney sections 32.

Figure 8:
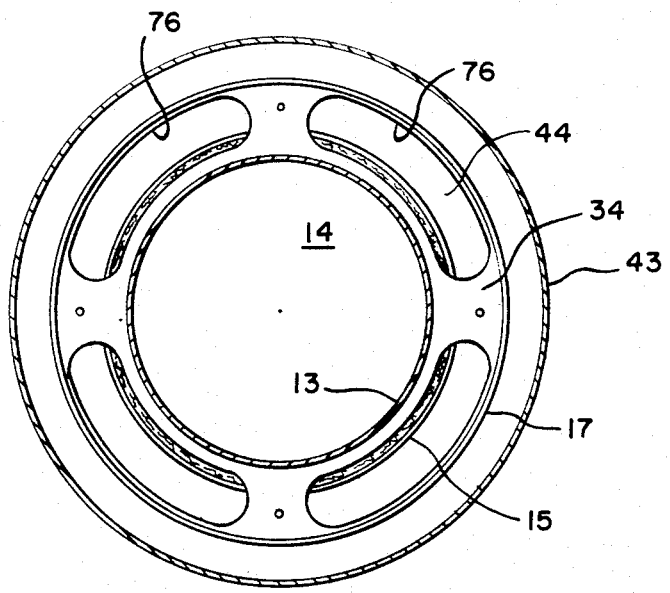
FIG. 8 is a cross sectional of the chimney cap and a top plan view of the upper end of a chimney member.
Figure 7:
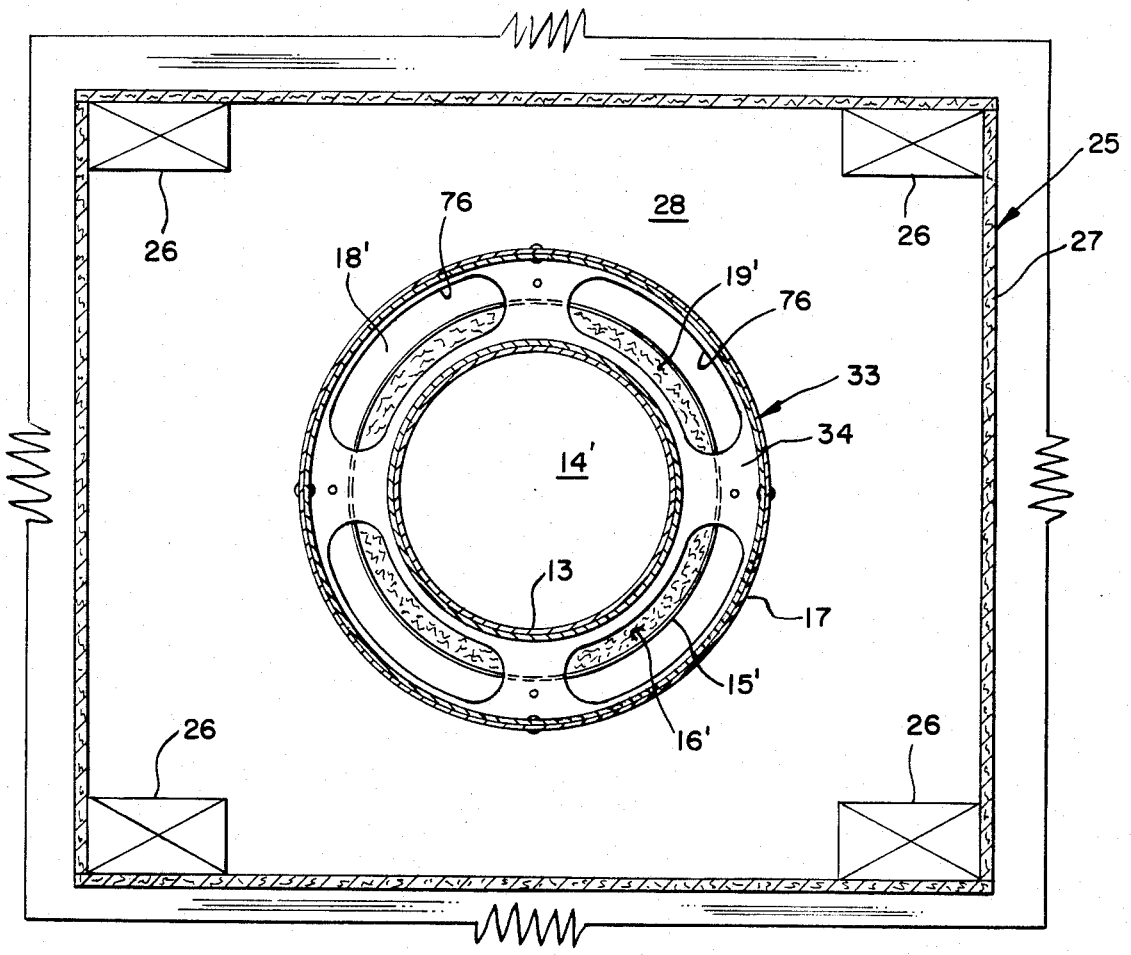
FIG. 7 is a cross sectional view of the chimney shown in FIG. 2 taken along line 7—7.
Figure 9:
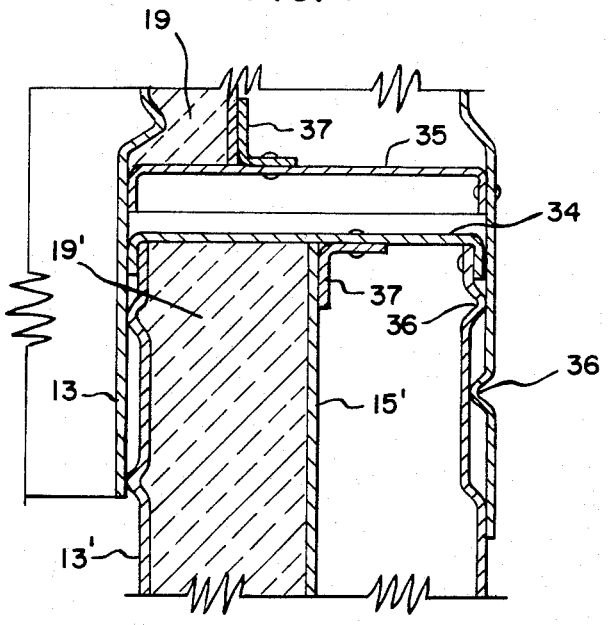
FIG. 9 is an enlarged cross sectional view of the chimney taken generally in the vicinity of lines 9—9 of FIG. 2.

The construction of the starter section and the chimney sections are generally identical with the exception of the addition of air openings 20 in the outer wall of the starter section. The construction of the sections follows standard practice and is illustrated in FIGS. 2, 8 and 9. Upper and lower spacer flanges 34 and 35 are connected to the outer wall by rivets. No rivet connection is made to the inner wall so as to permit thermal expansion of the inner flue relative to the outer wall. Appropriate indents 36 are made in the outer chimney walls so that they will twist lock together for easy assembly. Appropriate spacer blocks 37 are riveted to the chimney flanges 34 and 35 to hold the intermediate wall in relation to the inner and outer walls. Flange 34 is formed with a plurality of openings 76 which permit the free flow of air up through air passage chambers 18 and 18'. The chimney and starter sections also have openings 77 formed in flange 35. Openings 76 and 77 are preferably in alignment when the starter and chimney sections are locked together to provide for unrestricted upward air flow. Note that openings 76 and 77 are large enough to expose insulation chambers 16 and 16' so that heat in the chamber may be disipated upwardly.

Figure 3:
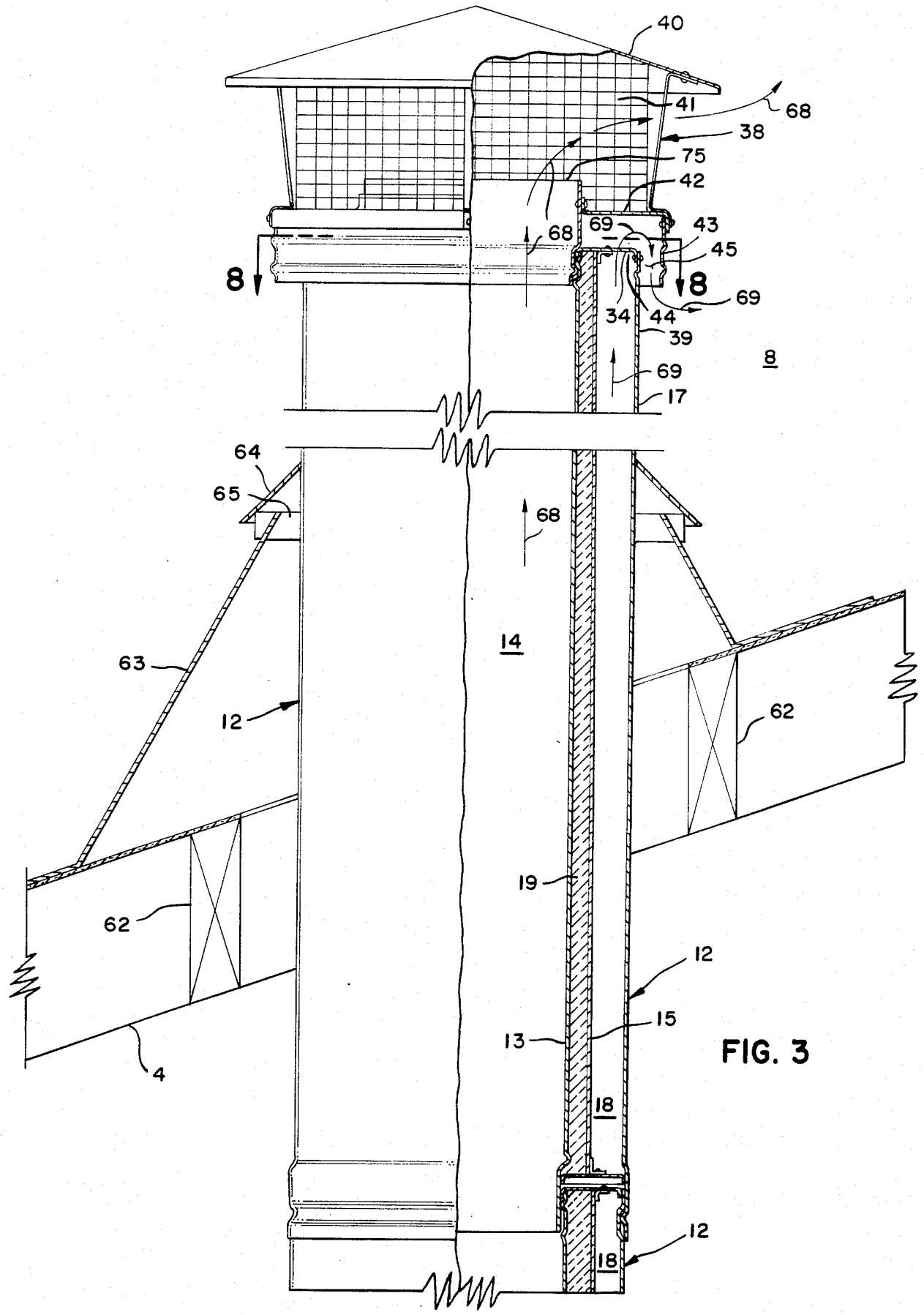
FIG. 3 is an enlarged side view of the chimney shown in FIG. 1 taken along line 3—3. Portions of the chimney and installation system are shown in cross section.

Referring to FIGS. 1 and 3, the chimney system preferably includes a chimney cap 38 connected to the top end 39 of the chimney member. The cap consists of a hood 40 mounted above the inner flue to prevent rainwater from entering the flue. An open mesh 41 serves to keep out birds and as a spark arrestor. A shroud consisting of a horizontal member 42 and a vertical member 43 covers the opening 44 to the air passage chamber 18 and prevents rain from entering the air passage chamber. The L-shaped passage 45 permits the air from the air passage chamber 18 to reach the atmosphere 8.

In another form of the invention, the stovepipe passes through the wall of the building to a chimney mounted on the outside of the building. It is standard practice to install a metal thimble in the wall to surround the stovepipe. The standard practice is to support the chimney on a Tee support bracket attached to the outside wall of the building. It is standard practice to build an air permeable structure around such outside chimneys for architectural purposes. Such a structure serves the same purpose as the air permeable structure 25 previously described in that it supplies a volume of air for flow through the air passage means in the starter section of the chimney and through the air passage chamber in the chimney sections. Since such structures are never air tight, greater volumes of air are taken directly from atmosphere in the event of very hot fires for prolonged periods of time or in the event of a chimney fire from the accumulation of creosote.

Installation of the chimney is as follows: At least a two inch clearance between the chimney and any combustible material must be allowed. Where the chimney passes through floors, joists, or ceilings, firestop spacers or support boxes may permit reduced clearances. Referring to FIG. 2, the upper end of the stovepipe section 10 is connected to the chimney snap lock adapter 11. The adapter is formed with an annular snap lock ring 46 which overlaps upturned flange 47 on chimney support 23. The starter section chimney inner wall 13' slips down between the single wall 48 of the snap lock adapter. This insures that any creosote which condenses in the chimney will flow down the inside of the stovepipe and into the stove itself where it will be burned.

The base 21 of the chimney starter member 33 rests on base 22 of the chimney support 23 which is formed with straps 49 which are bent over floor joist members 2 and blocking members 31 and nailed thereto. The lower end of the first chimney section 32 is set on top of the starter section 33 and twist locked together by standard detent means formed in the outer walls of the respective sections. As shown in FIGS. 2 and 9, the chimney inner wall 13 slips inside the inner wall 13' of the chimney starter section. As shown in FIG. 2, an opening 50 is left in floor members 51 so that there is open communication between air supply chamber 28 and chamber 29 formed between the outer wall 17' of the chimney starter member and inner wall 30 of the chimney support member.

Figure 4:
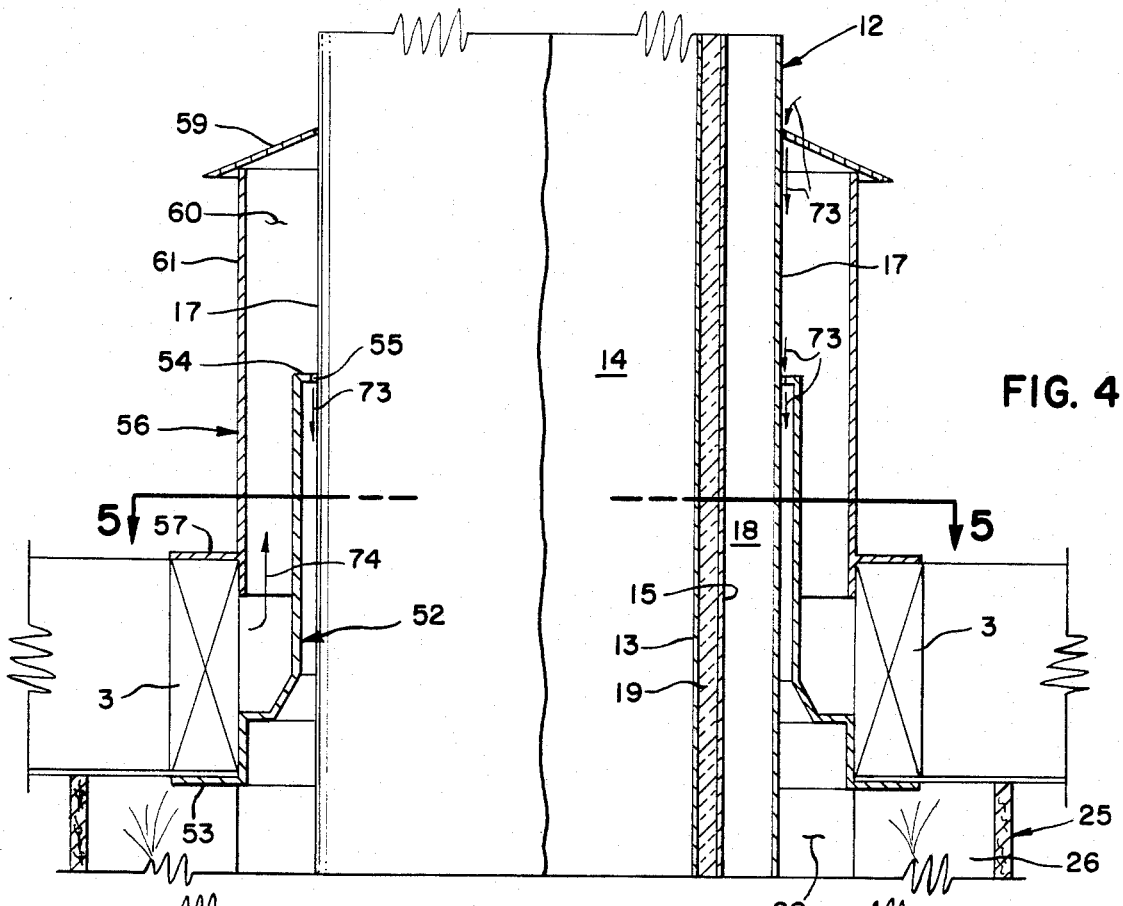
FIG. 4 is an enlarged side view of the chimney shown in FIG. 1 taken along line 4—4. Portions of the chimney and installation system are shown in cross section.
Figure 5:
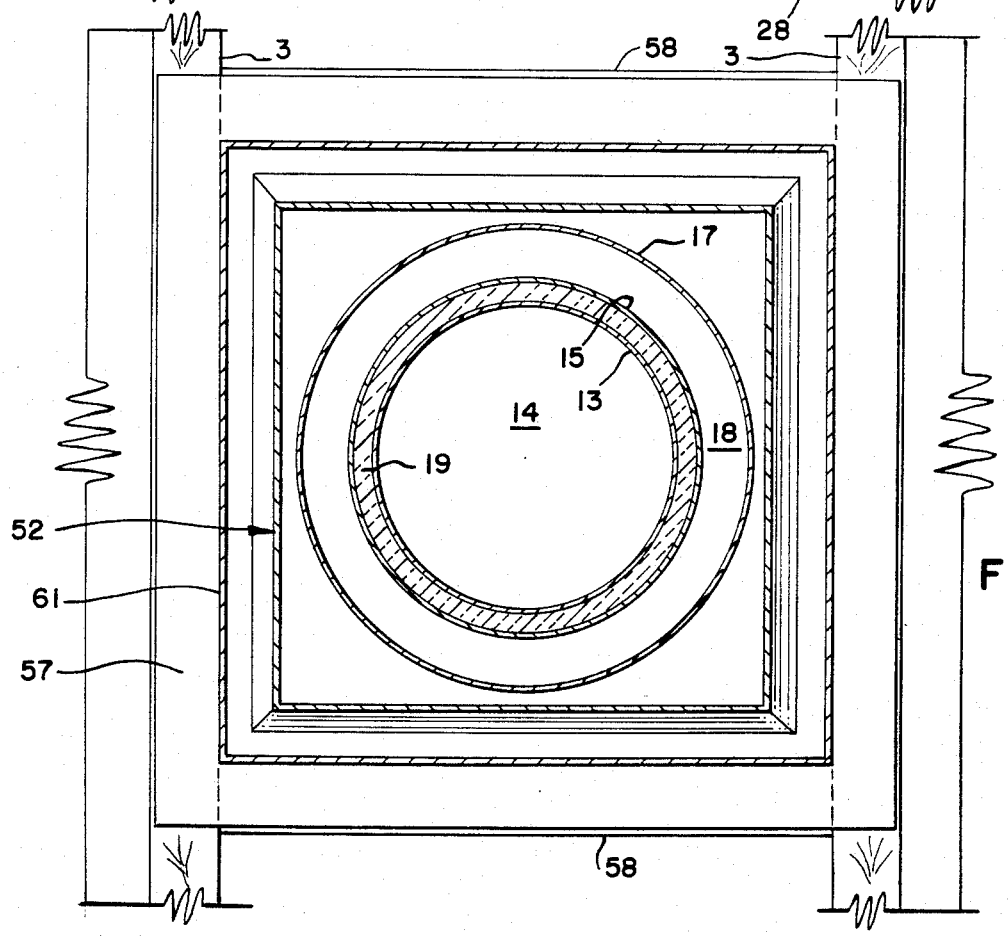
FIG. 5 is a cross sectional view taken along line 5—5 of FIG. 4.
Figure 6:
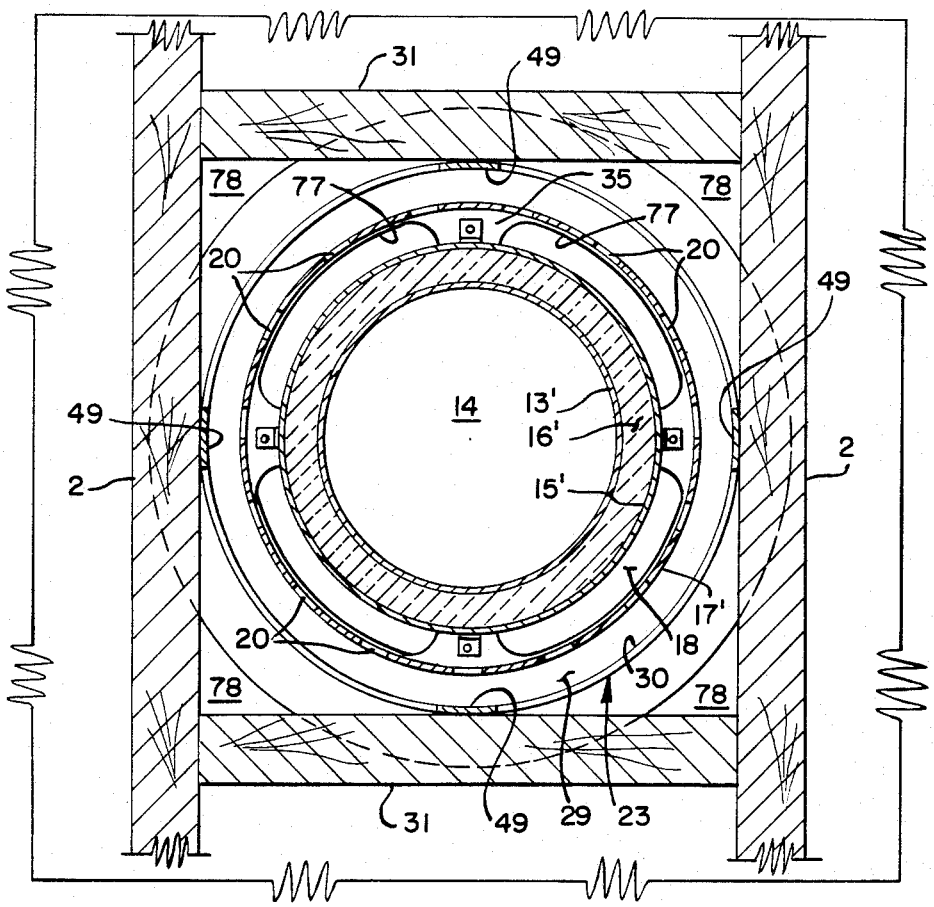
FIG. 6 is a cross sectional view of the starter section of the chimney taken along line 6—6 of FIG. 2 installed in a wood frame building.

Referring to FIGS. 1, 4, and 5, a detail of the passage of the chimney through the ceiling joist members and into the attic area 7 is illustrated. First, a chimney firestop radiation shield 52 is inserted up through the ceiling rafters until outer flange 53 butts up against ceiling rafter 3. The firestop is formed with an upper ange 54 which is formed with a circular opening 55 which fits closely around the outer wall 17 of the chimney thus preventing flames from passing through the opening in the ceiling from the room 6 to the attic 7. The firestop is securely connected to the ceiling rafters by nailing. Since most attics are insulated with blanket or loose particle insulation, an insulation shield 56 is installed from the attic downwardly over the chimney section until flange 57 rests on ceiling joist member 3 and blocking member 58. A collar 59 prevents any loose insulation or other objects from entering the chamber 60 between the outer wall of the chimney and the wall 61 of the insulation shield. While the firestop radiation shield will prevent the passage of flames, it will not prevent the passage of all air between the attic space 7 and the air supply chamber 28.

No special hardware is used where the chimney passes through the roof rafters. The standard wood framing members 62 are built around the chimney and roof flashing member 63 is attached to the roof joist members. A storm collar 64 prevents the entry of water down the opening 65 in the roof flashing member. Finally, the chimney cap 38 is placed on top of the upper most chimney section and the installation is complete except for additional roof braces which are not shown if the chimney rises more than a specified distance above the roof.

Operation of the chimney during normal operation is as follows. When there is no fire in the stove, the air in air passage chamber 18 of the chimney will be generally at the same temperature as the air in air supply chamber 28 and little or no flow will take place through openings 20 in the starter chimney wall 17' and there will be little or no flow up the air passage 18 to the chimney cap.

When a fire is built in the stove, however, and hot combustion gases represented by arrows 68 rise up the stovepipe 10, through the chimney snap lock adapter 11 and into the chimney flue chamber 14' of the starter section 33 and then up through the chimney flue chambers 14 of the chimney sections 32 and out opening 75 in the chimney cap 38, the temperature of chimney inner wall starter section 13' and inner walls 13 of the chimney sections rise rapidly. The insulation material 19' in the insulation chamber 16' of the starter section maintains the inner wall 13' at an elevated temperature and slows the rate of heat transmission to the air in air passage chamber 18'.

Because the temperatures in the starter section are likely to be higher than at any other straight chimney section in the entire chimney, optionally the insulation chamber 16' may have a thickness of about one inch and be filled with one inch of insulation. Since chimney sections which are constructed at an angle are also likely to get hotter at the angled portion, these chimney sections optionally may be constructed with an insulation chamber one inch thick and be filled with one inch of insulation material. All straight sections of chimney are constructed with an insulation chamber 16 about one half inch thick and filled with one half inch of insulation material. As the temperature rises in the insulation chambers 16 and 16', intermediate walls 15 and 15' are heated and begin to warm the air in air passage chambers 18 and 18'. The warmed air represented by arrows 69 in the air passage chambers rises and flows to the chimney top where it is evacuated through air passage 45 in the chimney cap 38. The reduced pressure in the air passage chambers caused by the rising warmed air causes the cooler air under slightly higher pressure from air supply chamber 28 to move downwardly as represented by arrows 70 through opening 50 and into chamber 29 in the chimney support member 23 where the cooler air flows through openings 20 in the starter section or through the bottom end of the air chamber 24 if the chimney is supported on legs and is not formed with openings 20. Note that a supply of air exists in the chamber 78 formed between floor joists 2 and blocking 31 and outer starter chimney wall 17'. This supply of air is immediately available on demand for movement through openings 20 and up air passage chambers 18' and 18. The cool air flowing up through the air passage chambers 18 and 18' carries heat away from the intermediate walls 15 and 15' and utlimately prevents high build-up of heat in the inner walls 13 and 13'. The flow of warm air up air passages 18 and 18' is relatively insignificant under normal chimney use conditions. The air, however, in air supply chamber 28 must be replaced and for this reason, the structure 25 built around the chimney must remain air permeable. Standard construction of structures around the chimney is normally air permeable so that there is no problem in blocking off the supply of air to the air supply chamber 28. Thus, room air will flow through the cracks in the air permeable structure as represented by arrows 71 to replace the air that is flowing up the chimney. Other sources of air for moving up the air passage chambers 18 and 18' can come from air leaks as represented by arrows 72 between the chimney support and the first floor ceiling 67 thus drawing a very small amount of air from room 5. Air can also be drawn out of the attic space 7 as represented by arrow 73 through cracks between the collar 59 and the chimney and between the insulation shield 56 and the ceiling joist members 3 and blocking 58 as shown by arrows 74.

In a very hot and prolonged fire in the stove or in the event of a creosote fire within the chimney itself, the rate of air flow in the above described air system is greatly increased. It is this ability to increase the rate and amount of cool air flowing on demand into the air supply chamber 28 and utlimately up through air passage chambers 8 and 18' that makes this system efficient under normal conditions by drawing only a very small amount of air out of the building, yet in times of emergency such as in a chimney creosote fire, needed cool air can be brought in to keep the outer chimney walls 17 and 17' cool enough to prevent combustion of the building structure adjacent the chimney. The air flow draws heat from both the inner flue as well as the outer wall of the starter and chimney sections.

Figure 2A:
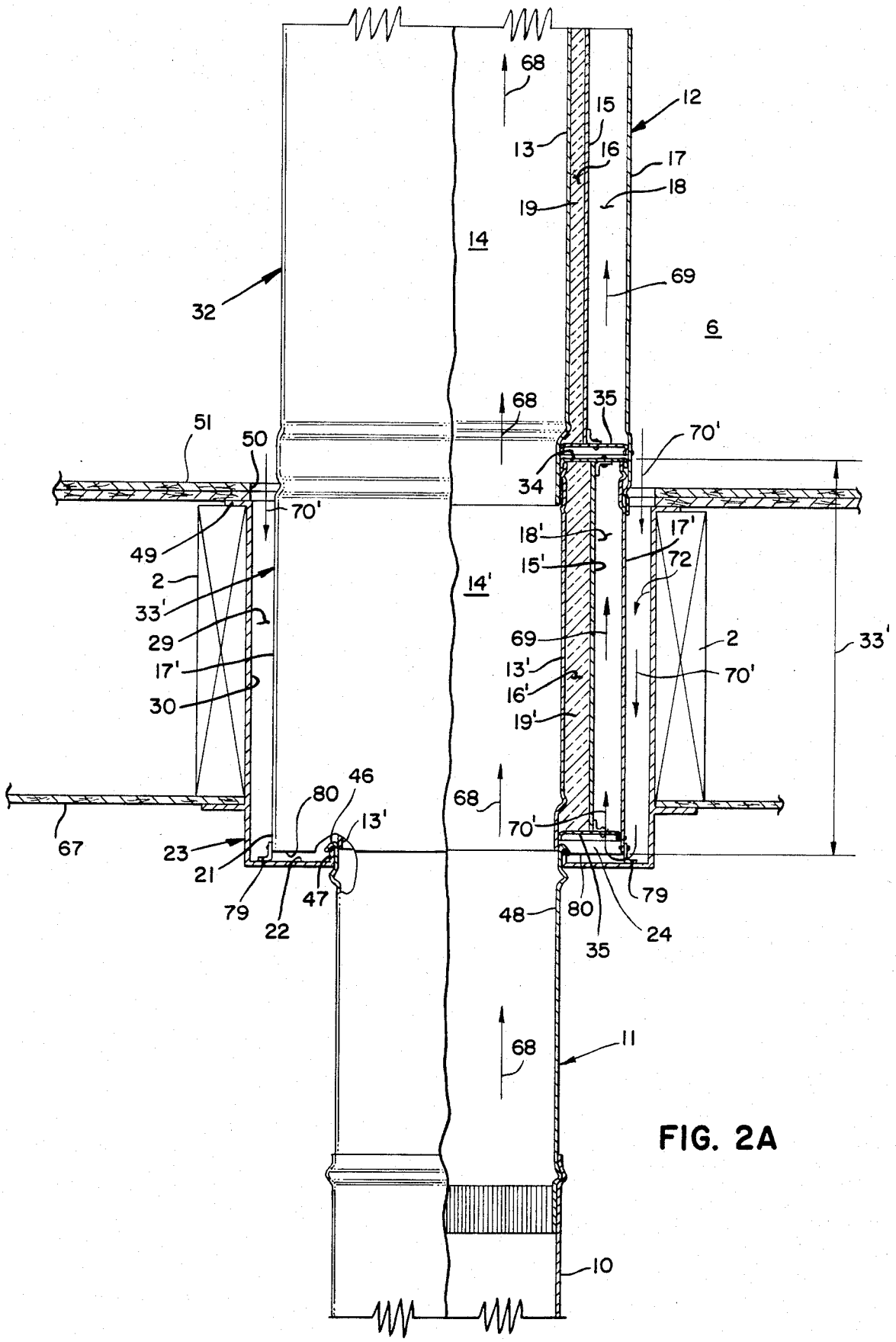
FIG. 2A is an alternate form of the invention taken in the same area as FIG. 2.

An alternate form of the invention is shown in FIG. 2A. The difference in the alternate structure from the previously described structure is that the air permeable structure enclosing a portion of the chimney is eliminated. Thus, the enclosure constructed from studs 26 and sheet rock 27 is eliminated. The air for passage up the air passage chambers 18 and 18' is supplied in unrestricted quantity from either a heated or unheated room, from an unheated attic area or if the starter section is located at the roof area, then the air will be drawn from outside the building.

The starter section is also shown in the alternate form. Instead of the air openings 20 as shown in FIG. 2, the starter section 33' is constructed with legs 79 which elevate the bottom edge of the chimney starter section above base 22 so that air as shown by arrows 70' can pass beneath the lower edge of the chimney starter section 80 and pass upwardly through air passage chambers 18 and 18'. In this form of the invention, there is an unrestricted flow of air 70' through passages 18 and 18'. It has been found however, that when the chimney is operating normally, there will only be a small amount of air pass up through chambers 18 and 18'. When there is a chimney creosote fire, the flow of air 70 greatly increases and there will be a substantial amount of air withdrawn from within the building. The heat loss from the building, as earlier stated, is unimportant relative to saving the structure from a possible fire in the building.

We claim:

1. An on demand air cooled three wall chimney system for a building sourcing cooling air from within said building comprising:

a. a starter chimney member having a first inner sheet metal wall forming a first imperforate elongated open ended chamber for the passage of flue gases from a fire source;

b. said starter chimney member having a first intermediate sheet metal wall surrounding and generally evenly spaced from said first inner wall and forming therewith a first insulation chamber;

c. said starter chimney member having a first outer metal wall surrounding said first intermediate wall forming a first open ended air passage chamber;

d. first insulation material substantially filling said first insulation chamber in said starter chimney member;

e. air passage means formed only in said lower portion of said starter chimney member permitting said air within said building to enter said first air passage chamber aajacent the lower end of said starter chimney member for movement only upwardly through said first open ended air passage;

f. an upper chimney member having a second inner sheet metal wall in over lapping registration with said first inner sheet metal wall forming a second imperforate elongated open ended chamber for the passage of flue gases from said first imperforate elongated open ended chamber to the atmosphere outside said building;

g. said upper chimney member having an intermediate sheet metal wall surrounding and generally evenly spaced from said inner wall and forming therewith a second insulation chamber;

h. said upper chimney member having a second outer metal wall surrounding said second intermediate wall forming a second open ended air passage chamber positioned for communication with said first open ended air passage chamber;

i. second insulation material substantially filling said insulation chamber in said upper chimney member; and j. a chimney cap means mounted externally of said building having a conduit in conmunication only with said second imperforate open ended chamber of said upper chimney for venting flue gases to atmosphere and a passage in communication only with said second open ended air passage chamber of said upper chimney member for venting said cooling air to atmosphere separately from said flue gases.

2. An on demand air cooled chimney system as described in claim 1 comprising:

a. a non-airtight enclosure structure means within said building enclosing a portion of said starter chimney member and said upper chimney member adjacent said air passage means in said starter chimney member providing a selected volume of air for immediate supply through said air passage means in said starter and uper chimney members; and b. said first insulation material and said first insulation chamber in said starter chimney member provide greater heat insulation than said second insulation material and said second insulation chamber in said upper chimney member.

3. An on demand chimney as described in claim 2 wherein:

a. said non-airtight enclosure structure enclosing a portion of said chimney adapted for receiving a supply of air from inside said building at a restricted flow rate for replenishing air withdrawn through said air passage means and through said first and second open ended air passage chambers in said starter chimney member and in said upper chimney member.

4. An on demand air cooled chimney system as described in claim 1 comprising:

a. said air passage means includes a plurality of openings in said first outer metal wall of said starter chimney member.

5. An on demand air cooled chimney system as described in claim 2 comprising:

a. said air passage means includes a stand off foot member positioned below said starter chimney member for permitting the passage of air from said non-airtight enclosure structure to said first air passage chamber in said starter chimney member.

6. An on demand air cooled chimney system as described in claim 1 comprising:

a. said inner metal wall is constructed from stainless steel high nickel content austenitic alloys.

7. An on demand air cooled chimney system as described in claim 6 wherein:

a. said inner metal wall material is Type 330 stainless steel.

8. An on demand air cooled chimney system as described in claim 6 wherein:

a. said inner metal wall material is Type 333 stainless steel.

9. An on demand air cooled chimney system as described in claim 1 wherein;

a. said first and second insulation chambers are open at both ends.

* * * * *

UNITED STATES PATENT AND TRADEMARK OFFICE

CERTIFICATE OF CORRECTION

PATENT NO. : 4,608,963

DATED : September 2, 1986

INVENTOR(S) : Donald M. Towsend and John R. Jacklich

It is certified that error appears in the above-identified patent and that said Letters Patent is hereby corrected as shown below:

Page 7, line 21, change "ange" to ---flange---

Page 9, line 53, change "aajacent" to ---adjacent---

Page 10, line 24, change "uper" to ---upper---

Page 10, line 33, after "chimney" insert ---is---

Signed and Sealed this

Twenty-fifth Day of November, 1986

*Attest:*

DONALD J. QUIGG

*Attesting Officer* *Commissioner of Patents and Trademarks*